United States Patent [19]

Borchardt

[11] Patent Number: 4,911,321

[45] Date of Patent: Mar. 27, 1990

[54] TRANSPORT UNIT

[76] Inventor: Dieter Borchardt, Rissener Dorfstr. 45, 2000 Hamburg 56, Fed. Rep. of Germany

[21] Appl. No.: 295,921

[22] Filed: Jan. 3, 1989

[30] Foreign Application Priority Data

Jan. 5, 1988 [DE] Fed. Rep. of Germany ..... 3800120

[51] Int. Cl.[4] ..... B65D 21/02

[52] U.S. Cl. ..... 220/23.83; 206/504

[58] Field of Search ..... 220/23.6, 23.83, 23.86; 206/504, 503, 507, 509, 821

[56] References Cited

U.S. PATENT DOCUMENTS

| | | | |
|---|---|---|---|
| 4,161,254 | 7/1979 | Taylor | 206/504 |
| 4,592,601 | 1/1986 | Hlinsky et al. | 206/504 |
| 4,799,592 | 1/1989 | Hessmert | 220/23.6 |
| 4,813,542 | 3/1989 | Thompson et al. | 206/504 |

*Primary Examiner*—Joseph Man-Fu Moy

*Attorney, Agent, or Firm*—Cushman, Darby & Cushman

[57] ABSTRACT

A method of combining at least two layers each having a odd number of ISO-containers by detachable coupling of corner fittings wherein two adjacent corner fittings of two containers of one layer and one of the corner fittings of a container from the other layer are aligned and the lateral anchoring opening of the aligned corner fittings of the one layer are bound by coupling elements which prevent a displacement of the containers parallel to the planes of their sidewalls relative to each other as well as normal to the planes of their sidewalls and absorb sharing forces. The upper and lower anchoring openings of the aligned corner fittings of the containers situated in different layers are coupled by middle twist locks which essentially prevent a displacement of the containers parallel to the plane of their base surfaces relative to one another as well as normal to the plane of their base surfaces and absorb sharing forced. The laterally displaced aligned corner fittings are coupled by their front-end anchoring openings by a clamping element.

13 Claims, 4 Drawing Sheets

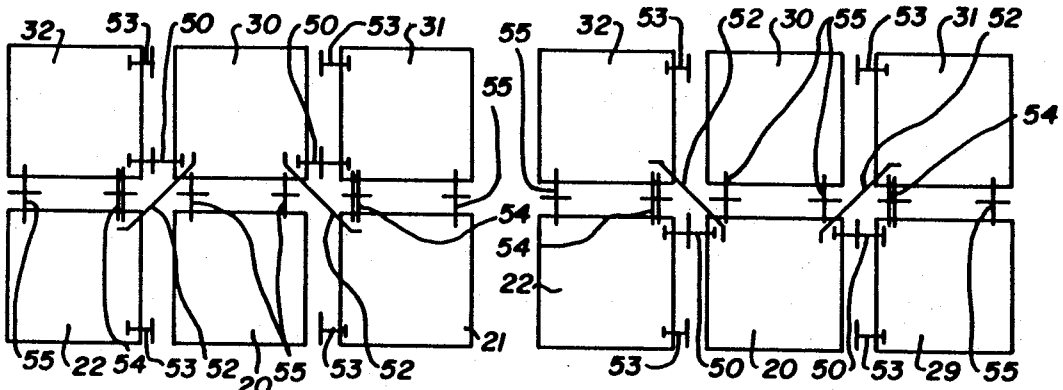
FIG. 4A
FIG. 4B
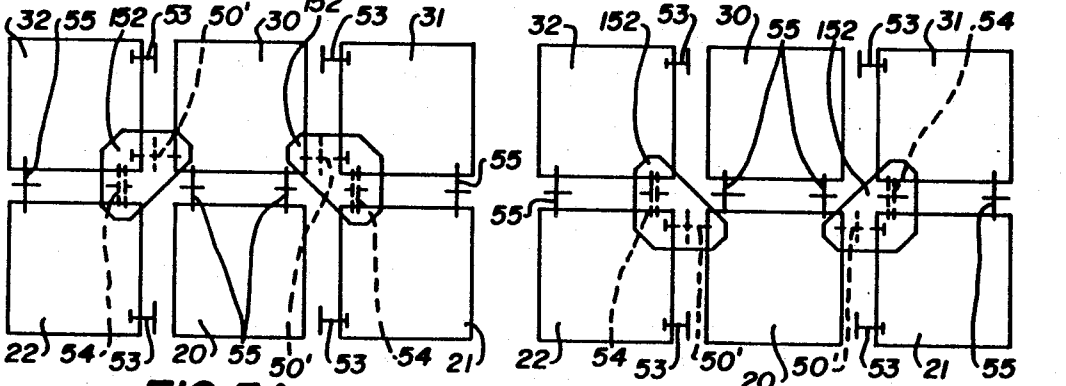
FIG. 5A
FIG. 5B

TRANSPORT UNIT

BACKGROUND OF THE INVENTION

1. Field of the Invention

The present invention relates to the method of forming a transport unit by combining at least two layers each comprising an odd number of ISO-containers by the detachable coupling of corner fittings in the region of two adjacent containers having juxtaposed side walls. The corner fittings are coupled by means of coupling devices which extend into anchoring openings whereby the anchoring openings present in the upper surface of the upper central container of the transport unit are left free for the engagement of locking heads of lifting equipment.

2. Description of the Related Art

A related method is described in European Patent Application 87730069.9 (U.S. application Ser. No. 07/139,665), the disclosure of which is incorporated herein by reference. In that method, adjacent containers are coupled so that when two layers of containers are present, the containers of one layer are coupled via the lateral anchoring openings of all the adjacent corner fittings and the containers of the other layer are coupled at least via the lateral anchoring openings of the corner fittings which are present on the same level. In this manner, the adjacent corner fittings of other layers can also be coupled together.

However, as noted in the above European Patent Application, as a result of the permissible tolerances in the spaces of the anchoring openings, the lateral anchoring openings of two adjacent containers are often in positions which are so different that it is simply not possible to couple them together. Therefore, in that European patent application, it was proposed that so called double function transverse elements be used, which enable the coupling of lateral anchoring openings of adjacent corner fittings which have been considerably offset from one another lengthwise of the container.

SUMMARY OF THE INVENTION

It is an object of the present invention to provide a method of combining ISO-containers such that no specifically constructed coupling elements are needed to overcome the difficulties in coupling displaced lateral anchoring openings.

Thus, in accordance with the present invention, a method is provided wherein on both sides of the vertical central plane through the center container, two adjacent corner fittings of adjacent containers of the one layer and one corner fitting adjacent to these corner fittings of a container of the other layer are aligned, wherein only one single container is aligned with two corner fittings and the lateral and/or front-end anchoring openings of the adjacent aligned corner fittings of the one layer as well as the lateral and/or front-end anchoring openings of the corresponding corner fittings of the other end of the containers are coupled by means of coupling elements which absorb shearing forces and essentially prevent displacement relative to each other of the containers parallel to the planes of their side walls as well as of the corners fittings normal to the plane of the side walls. Preferably, the remaining lateral anchoring openings of adjacent corner fittings are free of coupling means. Further, the upper and lower and/or front-end anchoring openings of the vertically aligned adjacent corner fittings of the containers in different layers as well as the upper and lower and/or front-end anchoring openings of the corresponding corner fittings on the other ends of the containers are coupled by means of middle coupling elements which absorb shearing forces and prevent the displacement of the containers parallel to the plane of their base surfaces relative to each other as well as of the corner fittings normal to the plane of their base surfaces. Further, the front-end anchoring openings of the aligned, laterally offset corner fittings of the containers of different layers as well as the corresponding corner fittings at the other ends of the containers are coupled by means of a rigid clamping element.

Therefore, unlike the method of the above European Patent Application, in accordance with the present invention, in one layer of containers there are always only two corner fittings of adjacent containers, coupled by their lateral and/or front-end anchoring openings while the containers of the other layer are coupled with the one layer via middle coupling elements and the inclined clamping elements of the front-end anchoring openings.

Thus, the method in accordance with the present invention permits coupling of corner fittings, which are aligned to each other beforehand, wherein the alignment takes place in such a way that with two layers each having, for example, three containers, one of the middle containers is aligned with two of its corner fittings, whereas the four outer containers are aligned with only one single corner fitting. Thus, the anchoring openings of the aligned corner fittings are not relatively displaced while the anchoring openings of the corresponding corner fittings on the other ends of the containers can themselves be relatively displaced with the greatest variation within the tolerance range of merely ten mm which provides no problem for coupling. The lateral anchoring openings of the adjacent containers, lying on a different level in the one layer and the non-aligned corner fittings in the other layer can on the other hand have a displacement of several centimeters in the lengthwise direction of the containers.

Accordingly, with the method of the present invention, coupling can take place with a relatively lesser number of adjacent corner fittings than was the case with the method described in the European Patent Application above and the coupling devices used can absorb essentially all load forces occurring during use.

The present invention further relates to a transport unit of at least two layers each comprising an odd number of ISO-containers which are coupled together by the detachable coupling of corner fittings in the region of two adjacent containers having juxtaposed sidewalls by means of coupling devices extending into anchoring openings, whereby the anchoring openings present in the upper surface of the upper central container of the transport unit are left free for the engagement of locking heads from lifting equipment. This type of transport unit is distinguished in accordance with the present invention in that on both sides of the vertical middle plane through the central container, two adjacent corner fittings of adjacent containers of the one layer are aligned with one adjacent corner fitting of a container from the other layer. The aligned corner fittings as well as the corresponding corner fittings on the other end of these containers are coupled with the lateral and/or front-end anchoring openings of these corner fittings by engaging coupling elements which essentially prevent a displacement of the containers in a plane parallel to their sidewalls relative to one another as well as the coupled corner fittings normal to the sidewalls, with the couplings absorbing shearing forces. Preferably the lateral anchoring openings of the remaining corner fittings are not coupled. Further, the upper and lower and/or front end anchoring openings of the vertically adjacent corner fittings of the containers in different layers and the upper and lower and/or front-end anchoring openings of the corresponding corner fittings on the other end of the containers are coupled by means of other coupling elements. These coupling elements essentially prevent a displacement of the containers in the plane parallel to their base surfaces relative to one another as well as of the coupled corner fittings normal to the plane of their base surfaces and absorb shearing forces. Further, the front end anchoring openings of the aligned, laterally offset corner fittings of the containers in different layers and the corresponding corner fittings on the other end of the containers are each coupled through a rigid clamping element.

The layers of containers of this type of transport unit can be coupled in the region of non-aligned corner fittings by middle coupling elements, e.g. middle twist locks.

A clamping element which has three locking heads on a rigid support part can be used for coupling aligned corner fittings via the front-end anchoring openings so that the tensile and compressive forces are absorbed and further so that forces acting in other directions can be absorbed or transmitted. Such a clamping element can, for example, accept a whole coupling between the two adjacent containers of one layer as well as possibly the coupling between adjacent and vertically aligned corner fittings of containers from different layers. Moreover, the clamping element can have a rigid support part on which three locking heads are provided on corner points of a right-angled triangle for engaging with end anchoring openings of the ISO-containers.

Two of the locking heads of this type of clamping element can have non-rotatable locking projections essentially lying on a plane parallel to the plane of the support part which extend vertically to the connecting line of both triangulation points of their locking heads and away from the third locking head while the third locking head is rotatably mounted on the support part.

BRIEF DESCRIPTION OF THE DRAWINGS

FIGS. 4A and 4B are schematic elevational views of two layers of containers coupled to each other;

FIGS. 5A and 5B are schematic elevational views of two layers of containers coupled to each other;

DETAILED DESCRIPTION OF THE PRESENTLY PREFERRED EXEMPLARY EMBODIMENTS

Figure 1:
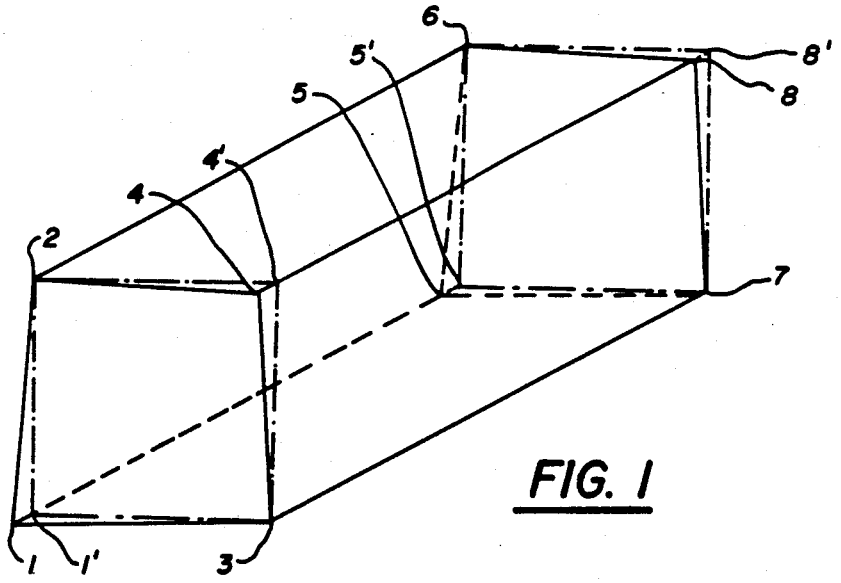
FIG. 1 is a schematic perspective view of a ISO-container showing the possible variation from the ideal quadrangular form through permissible tolerances.

The ISO-container shown schematically in FIG. 1 has eight corner points 1–8 which, as a result of the permissible tolerances in the a corner point of a quadrangle, shown by the dotted line in FIG. 1. As can be seen, corner points 1, 4, 5 and 8 of the container lie at a noticeable distance from the corresponding corner points 1', 4', 5', and 8' of the quadrangle. The distances between the corner points of the container and the corresponding corner points of the accurate-to-size quadrangle can be as great as 20 mm per container surface even as newly made.

Figure 2:
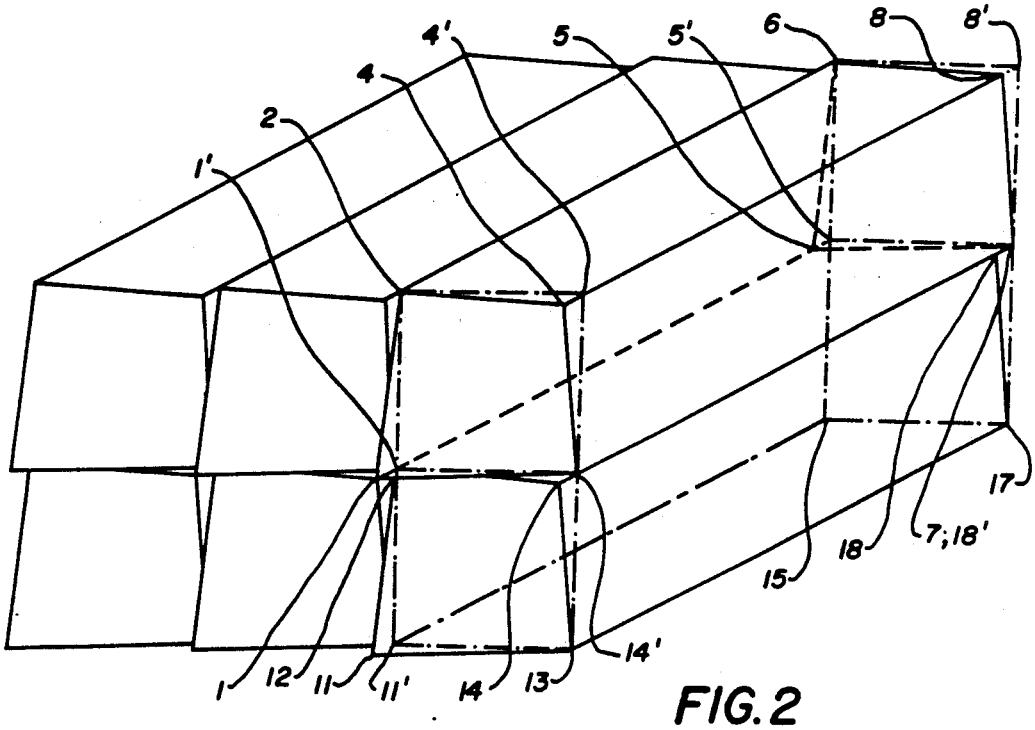
FIG. 2 is a schematic perspective view of two layers of ISO-containers of the type shown in FIG. 1, showing the possible error of alignment of the end surfaces through permissible tolerances.

Thus, as shown in FIG. 2, there is an alignment error between adjacent containers when corresponding containers were stacked as each of the containers can vary from the actual basic form of a quadrangle. Consequently, the corner fittings of adjacent containers with their sidewalls in parallel juxtaposition, that is the corner fittings of a container of a layer of containers, are normally not aligned exactly with one another. This means that coupling by lateral anchoring openings can only be achieved if specifically adapted coupling links are provided which spread the tolerances.

Figure 3:
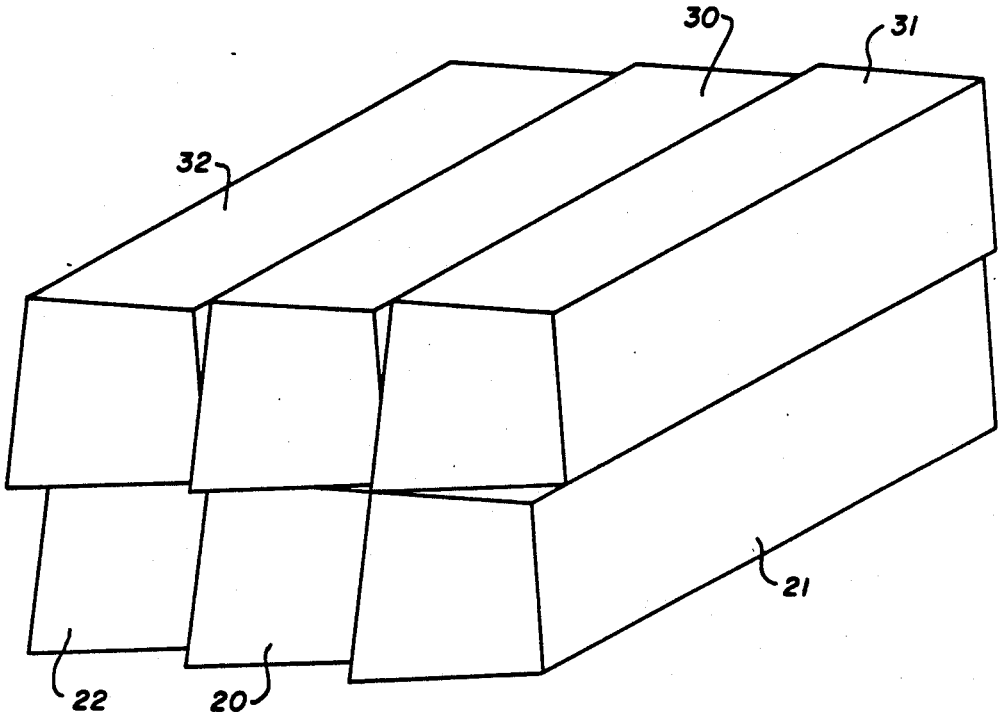
FIG. 3 is a schematic perspective view similar to FIG. 2 where two adjacent upper corner fittings of the lower layer and one of the adjacent, lower corner fittings of the upper layer of the containers are aligned with one another.

FIG. 3 shows in schematic form an arrangement of two layers of containers, each having three containers, 20, 21, 22, 30, 31 and 32 which lie on top of each other. The containers are arranged so that the containers on top of one another 20, 30 and 21, 31 and 22 32 are aligned by their sidewalls and adjacent containers of a single layer are closely juxtaposed with their sidewalls. Further, containers 20 and 21 of the lower layer and container 31 of the upper layer of containers are arranged so that the front sides of the upper right corner fitting of container 20, the upper left corner fitting of container 21 and the lower left corner fitting of container 31 in FIG. 3 all lie essentially in a vertical plane.

This alignment results in an essentially equal alignment of the corresponding corner fittings on the other end of containers 20, 21 and 31. Where, as a result of the permissible tolerances, only a maximum variation of 10 mm can occur which poses no problem for couplings to be carried out. It should be noted that the maximal variation present can even be divided between both container ends.

To form a transport unit from 6 containers as shown in FIG. 3, furthermore, containers 20, 22 and 32 are aligned in such a way that the upper left corner fitting of container 20, the upper right corner fitting of container 22 and the lower right corner fitting of container 32 in FIG. 3 are juxtaposed without any considerable error of alignment in their lateral anchoring openings. With a layout of this type, it can be seen that each of the upper corner fittings of the lower middle container 20 are aligned while containers 21, 22, 31 and 32 which lie on both sides of the middle plane through middle containers 20, 30 are each aligned with only one single corner fitting. For coupling a layout of this type, as shown in FIG. 4B, the adjacent containers 20, 21 and 20, 22 are coupled via the lateral anchoring openings of the aligned upper corner fittings by means of twist locks 50 as set forth and described in FIGS. 31 and 32 of European Patent Application 87730069.9. These twist locks 50 not only couple the containers by preventing a separation of the corner fittings in a direction normal to the sidewalls of containers 20, 21 and 22 but also absorb shearing forces in the planes of the sidewalls.

In addition, supporting elements 53 are inserted into the lower lateral anchoring openings of the sides of container 21 facing container 22, but are not coupled with the lateral anchoring openings of container 20. An arrangement of this type is described in German Patent Application P3800119.5 having a filing date which is the same as applicants priority date.

The layers of containers 20, 21 and 22 and 30, 31 and 32 are bound together through middle coupling elements 55 which, for example, can be in the form of middle twist locks as presented in FIGS. 34 and 35 of European Patent Application 87730069.9. However, it is to be appreciated that rather than using middle twist locks 55, pin locks could be employed.

In addition to the middle twist lock 55, containers 21 and 31 and 22 and 32 are coupled via the upper and lower anchoring openings of their aligned corner fittings by middle twist locks 54. Middle twist locks 54 can correspond in their arrangement to the arrangement of the middle twist locks 55 by which, however, not only the engaging collar in the upper anchoring opening of the lower container 21 or 22 of middle twist lock 54 corresponds to the shape and size of the anchoring opening, but also the collar engaging with the lower anchoring openings of the upper container 31 or 32. The insertion of middle twist locks with such exact match is not prevented because the locks are aligned. However, it is possible that these middle twist locks, by virtue of their collars matching the shape and size of both anchoring openings can ensure that the coupled containers can not be displaced in the plane of their base surfaces or parallel to the dividing plane of the two layers of containers. The lower heads of the middle twist locks 54 adjacent twist lock 50 can be solidly engaged with the plug of twist lock 50 as shown in FIG. 39 of the above referenced European Patent Application, 069.9. Again, here, pin locks can be employed rather than middle twist locks 54.

In addition to twist locks 50 and middle twist locks 54 and 55 clamps 52 are employed for coupling of the aligned corner fittings of containers 20 and 31 and containers 20 and 32. Clamps 52 have a rigid support part with locking heads and is engaged with the front-end anchoring openings of the aligned corner fittings which are laterally displaced with regards to the vertical. In other words, the upper right corner fitting of middle lower container 20 and the lower left corner fitting of the outer upper container 31 as well as the corresponding containers 20 and 32 are coupled with a clamp 52 as described in greater detail below with reference to FIG. 6–7.

As can be further seen in FIGS. 4A–5B, supporting elements 53 are also mounted to containers 31 and 32 corresponding to those in the lower layer of containers.

With the foregoing coupling structure, containers 20, 21 and 22 of the lower layer are held in a fixed position by means of twist lock 50 while outer containers 31, 32 of the upper layer are held in a fixed position in a direction parallel to the separation plane of the layer of containers by twist locks 54. The remaining middle twist locks 55 further secure the bond between the containers of the upper and lower containers. The clamps help to 52 absorb shearing forces (between the outer and the middle containers) if there is stress in the direction of a vertical displacement of middle containers 20, 30 with respect to outer containers 21, 31 and 22, 32 and are thereby loaded with tension or pressure.

The configuration illustrated in FIG. 4A corresponds substantially to that of FIG. 4B and, accordingly, corresponding parts are designated with the same reference numbers. As can be seen, then, the difference with the configuration of FIG. 4B is that containers 30, 31, 32 of the upper layer are bound with lateral anchoring openings of the aligned corner fittings by engaging the twist lock 50 and thereby clamp 52 also extends from the lower corner fitting of the middle container 30 of the upper layer to the upper inner corner fitting of the outer containers 21 and 22 of the lower layer, aligned with them.

The configuration of FIGS. 5A and 5B corresponds essentially to those from FIGS. 4A and 4B, thus, the corresponding parts are designated with the same reference numbers. As distinguished from the structures shown in FIGS. 4A and 4B, however, clamping elements 152 are used instead of clamp 52. Clamp 152 will be described more particularly below with reference to FIGS. 6–8.

Figure 6:
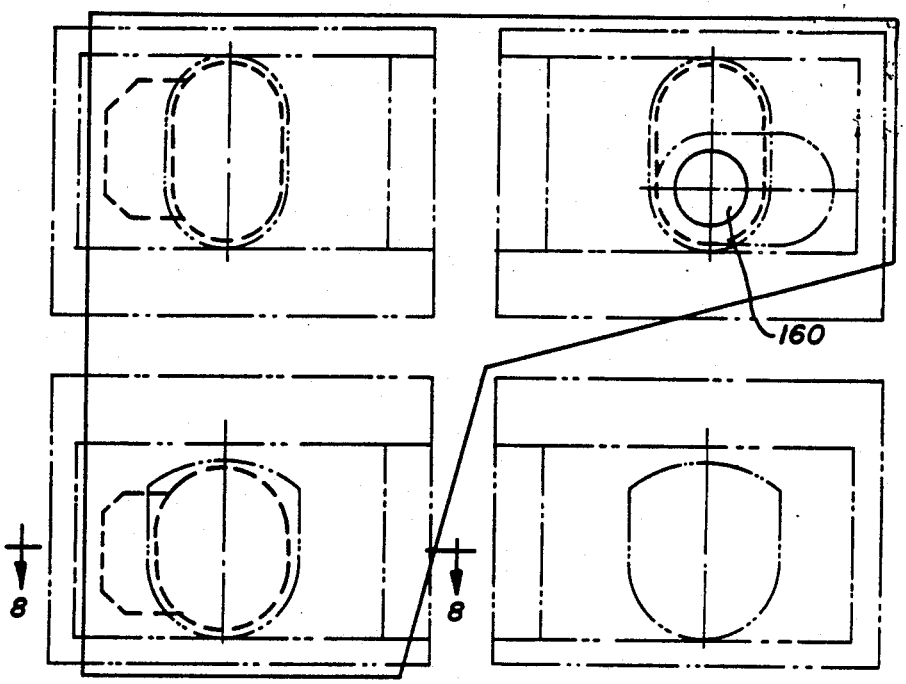
FIG. 6 is a schematic elevational view of a clamp with three locking heads for engaging front-end anchoring openings of adjacent corner fittings in accordance with the present invention.
Figure 7:
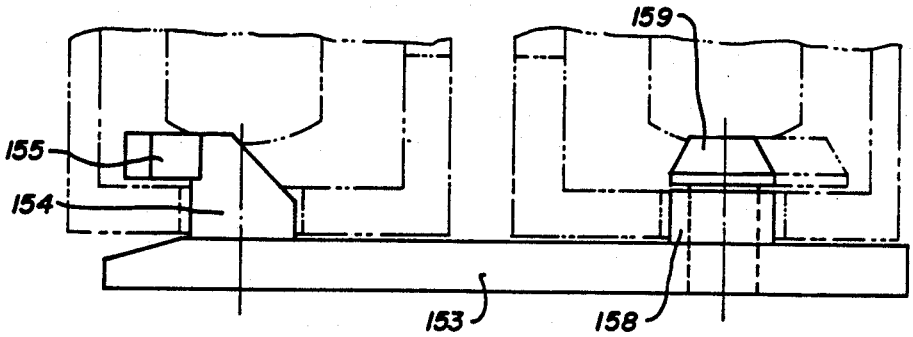
FIG. 7 is another view of the clamp of FIG. 6.
Figure 8:
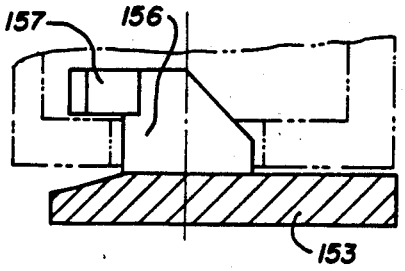
FIG. 8 is a cross-sectional view taking along line 8—8 in FIG. 6.

Referring to FIGS. 6–8, the clamping element is shown in its working condition and corresponds, for example, to the left clamping element 152 from FIG. 5A which is engaged with the lower right front-end anchoring opening of container 32, the lower left front-end anchoring opening of container 30 and the upper right front-end anchoring opening of container 22. The corresponding anchoring openings and corner fittings are indicated in FIGS. 6–8 by a dash-and-two-dots line.

The clamping element 152 has a plate-shaped rigid support part 153 with three locking heads mounted thereon. Upper left locking head as shown in FIG. 6 has a neck 154 which as can be seen by the broken line in FIG. 6 is formed to correspond to the lower front-end anchoring opening. Lower locking head 156 has a neck having a form as shown in broken lines approximately corresponding to a upper front-end anchoring opening. A right angled projection 155 is formed on neck 154 and a corresponding locking projection 157 is formed on neck 156. The locking heads can thus be inserted with locking projections 155, 157 in the corresponding front-end anchoring openings by tilting the plate-shaped support part around a line running parallel to the connection line between the anchoring openings lying beneath one another in FIG. 6 such that locking projections 155, 157 reach behind the edge region of the front end anchoring openings on the outer sides in FIGS. 6–7 when tilted in a plane in which support part 153 essentially runs parallel to the front surfaces of the aligned corner fittings shown in FIG. 7.

When neck 158 which, as shown in broken lines in FIG. 6 essentially has the form of a lower front-end anchoring opening, is formed on the plate-shaped support part 153 and is positioned with respect to both the other locking heads in such a way that it is situated exactly in the region of the front-end anchoring opening of the correspondingly aligned corner fitting it can be inserted into the associated front-end anchoring opening. A rotatable shaft 160 extends through neck 158 and support part 153 and can be turned from the exterior, for example, using a key or similar structure and carries a locking head 159 which has a form shown by a dash-and-three-dots-line in FIG. 6. In one position, this locking head can be inserted through the front-end anchoring opening and then turned in a position as shown in a dash-and-three-dots line in FIGS. 6 and 7 and in which locking head 159 reaches behind the front-end anchoring opening and locks.

As noted above, clamping elements 152 are used in the assembly according to FIGS. 5A and 5B where it not only enables diagonal fastening as shown in FIGS. 4A and 4B but strengthens the entire coupling.

In the arrangement shown in FIGS. 5A and 5B, coupling elements 50' are present rather than twist locks 50 from FIGS. 4A and 4B. Coupling elements 50' can correspond to those from FIGS. 48 and 49 of the European Patent Application 877300689.9 referenced above. Such couplings 50' do not transmit any tensile force. The tensile force can be absorbed by clamping element 152. Using a clamping element 152 means also that coupling element 50 or 50' is no longer strictly necessary as clamping element 152 is able to absorb also both the tensile and shearing force which in the arrangement shown in FIGS. 4A and 4B would be absorbed by twist lock 50. The adjacent containers, for example 20, 21, and 30, 31 can then have directly juxtaposed sidewalls because in this case the support elements 53 are not needed. The latter is also possible if coupling element 50 or 50' is not provided with a plate.

If clamping element 152 and, particularly, its support part are formed with sufficient strength, then clamping element 152 can take on the function of the middle twist locks 54 shown in FIGS. 4A, 4B, 5A and 5B, and thus, twist locks 54 will no longer be necessary.

Finally, as can be seen in FIG. 6–8, a clamp 52 as is inserted in FIGS. 4A and 4B, can be made by omitting the left upper locking head from FIG. 6 and forming the support part correspondingly narrower.

What is claimed is:

1. A method for combining into a transportation unit at least two layers each with an odd number of ISO-containers in which each ISO-container comprises a rectangular, box-like member having a horizontal upper wall and a horizontal lower wall, two vertical opposite side walls and two vertical opposite end walls provided at longitudinally opposite ends of said side walls, which walls of each container, in respective sets of three, meet one another at four lower corners and four upper corners, of which each upper corner is provided with an ISO-upper corner fitting having an upper anchoring opening through said upper wall into an upper corner fitting cavity, a side anchoring opening through a respective said side wall into said upper corner fitting cavity, and an end anchoring opening through a respective said end wall into said upper corner fitting cavity, and of which each lower corner is provided with an ISO lower corner fitting having a lower anchoring opening through said lower wall into a lower corner fitting cavity, a side anchoring opening through a respective said side wall into said lower corner fitting cavity, and an end anchoring opening through a respective said end wall, in which each upper container is arranged in substantially superimposed juxtaposition with a respective lower container, comprising:

providing at least three containers for each layer and arranging the lateral containers at opposite sides of the central container with the containers disposed side-by-side, aligning lateral containers on each side of a vertical middle plane through said central container of one layer with the central container of said one layer at a corner fitting and with an adjacent corner fitting of an adjacent container of the other layer whereby only a single container of the aligned containers on the one layer is aligned at two of its corner fittings;

coupling at least one of the lateral and front-end anchor openings of the one layer as well as at least one of the lateral and end-anchoring openings of the corresponding corner fittings on the other end of the containers of the one layer by means of coupling elements which prevent a displacement of the aligned containers of the one level parallel to the plane of their sidewalls relative to each other as well as the coupled corner fittings normal to the lane of their side walls and absorb any shearing force;

coupling at least one of the upper and lower anchoring openings and the front-end anchoring openings of the aligned, vertically adjacent corner fittings of the upper and lower containers in different container layers as well as at least one of the upper and lower and the front-end anchoring openings of the corresponding corner fittings on the other end of the containers by means of the middle twist locks for preventing a displacement of the containers parallel to the plane of their base surfaces relative to each other as well as the corner fittings normal to the plane of the base surfaces and which absorb any shearing force; and coupling the front-end anchoring openings with the aligned corner fittings of the containers which are laterally displaced from one another in different layers as well as the corresponding fitting on the other end of the containers by means of a rigid clamping element whereby the anchoring openings present in the upper surface of the upper central of the container transport unit are left free for the engagement of locking heads of lifting equipment for lifting said transportation unit, as a unit, from said four upper corner fittings.

2. A transport unit having at least two layers each with an odd number of ISO-containers in which each ISO-container comprises a rectangular, box-like member having a horizontal upper wall and a horizontal lower wall, two vertical opposite side walls and two vertical opposite end walls provided at longitudinally opposite ends of said side walls, which walls of each container, in respective sets of three, meet one another at four lower corners and four upper corners, of which each upper corner is provided with an ISO-upper corer fitting having an upper anchoring opening through said upper wall into an upper corner fitting cavity, a side anchoring opening through a respective said side wall into said upper corner fitting cavity, and an end anchoring opening through a respective said end wall into said upper corner fitting cavity, and of which each lower corner is provided with an ISO lower corner fitting having a lower anchoring opening through said lower wall into a lower corner fitting cavity, a side anchoring opening through a respective said side wall into said lower corner fitting cavity, and an end anchoring opening through a respective said end wall, in which each upper container is arranged in substantially superimposed juxtaposition with a respective lower container, each layer including at least three containers, the lateral containers being arranged at opposite sides of the central container with the containers disposed side-by-side, lateral containers on each side of a vertical middle plane through said central container of one layer being aligned with the central container of said one layer at a corner fitting and with an adjacent corner fitting of an adjacent container of the other layer whereby only a single container of the aligned containers on the one layer is aligned at two of its corner fittings, and including:

means for coupling corner fittings of aligned containers of one layer as well as the corresponding corner fittings on the other end of said containers via at least one of the lateral and front-end anchoring openings of the corner fittings by means of coupling elements which prevent displacement of the containers in a plane parallel to their sidewalls relative to each other as well as displacement of the coupled corner fittings normal to the sidewalls and absorb the shearing force, means for coupling at least one of the upper and lower and front-end anchoring openings of the vertically aligned corner fittings of the containers in different layers as well as at least one of the upper and lower and front-end anchoring openings of corresponding corner fittings on the other end of the containers by means of middle coupling elements which essentially prevent displacement of containers in a plane parallel to their base surfaces relative to each other as well as displacement of the coupled corner fittings normal to the plane of the base surfaces and to absorb the shearing force, and a right clamp element coupling the front-end anchoring openings of the aligned laterally displaced corner fittings, of the containers in different layers on each end of the containers whereby the anchoring openings present in the upper surface of the upper central of the container transport unit are left free for the engagement of locking heads of lifting equipment.

3. A transport unit as in claim 2, wherein the layers of containers are coupled in the region of non-aligned corner-fittings by middle twist locks.

4. A transport unit according to claim 2, wherein the front-end anchoring openings of the aligned corner fittings as well as the corresponding corner fittings on the other end of the containers are each coupled by means of a clamping element which has three locking heads defined on a rigid support part, each of said locking heads being engaged with one of the front-end anchoring openings.

5. A transport unit according to claim 3, wherein the front-end anchoring openings of the aligned corner fittings as well as the corresponding corner fittings on the other end of the containers are each coupled by means of a clamping element which has three locking heads are being engaged defined on a rigid support part, each of said locking heads being engaged with one of the front-end anchoring openings.

6. A transport unit according to claim 4, wherein said three locking heads define a right-triangle for engagement with front-end anchoring openings of the ISO-containers.

7. A transport unit according to claim 5, wherein said three locking heads define a right-triangle for engagement with front-end anchoring openings of the ISO-containers.

8. A transport unit according to claim 6, wherein two of said locking heads have non-rotatable locking projections essentially lying in a plane parallel to the plane of the support part and which extent vertically away from the connecting line of both triangulation points of their locking heads and from the third locking head and the third locking head is mounted so as to be rotatable on the support part.

9. A transport unit according to claim 7, wherein two of said locking heads have non-rotatable locking projections essentially lying in a plane parallel to the plane of the support part and which extent vertically away from the connecting line of both triangulation points of their locking heads and from the third locking head and the third locking head is mounted so as to be rotatable on the support part.

10. A transport unit according to claim 6, wherein each of said locking heads has a neck rigidly bound to said support part and having a shape and size substantially corresponding with that of the front-end anchoring openings.

11. A transport unit according to claim 7, wherein each of said locking heads has a neck rigidly bound to said support part and having a shape and size substantially corresponding with that of the front-end anchoring openings.

12. A transport unit according to claim 8, wherein each of said locking heads has a neck rigidly bound to said support part and having a shape and size substantially corresponding with that of the front-end anchoring openings.

13. A transport unit according to claim 9, wherein each of said locking heads has a neck rigidly bound to said support part and having a shape and size substantially corresponding with that of the front-end anchoring openings.

* * * * *